US006683235B2

(12) United States Patent
Aoki

(10) Patent No.: US 6,683,235 B2
(45) **Date of Patent: *Jan. 27, 2004**

(54) TONE HOLE PAD FOR A WIND INSTRUMENT

(75) Inventor: Hiroshi Aoki, Tokorozawa (JP)

(73) Assignee: Muramatsu Flute Manufacturing Co., Ltd., Tokorozawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/270,304

(22) Filed: Oct. 15, 2002

(65) Prior Publication Data

US 2003/0070531 A1 Apr. 17, 2003

(30) Foreign Application Priority Data

Oct. 15, 2001 (JP) ..... 2001-316986

(51) Int. Cl.[7] ..... G10D 7/08
(52) U.S. Cl. ..... 84/285 P; 84/385 A
(58) Field of Search ..... 84/385 P, 385 A

(56) References Cited

U.S. PATENT DOCUMENTS

| | | | |
|---|---|---|---|
| 3,295,403 A | 1/1967 | Kindlesparker | |
| 4,967,632 A | 11/1990 | Etheredge, III et al. | |
| 5,183,954 A | 2/1993 | Wasser | |
| 5,417,135 A | 5/1995 | Straubinger | |
| 5,469,771 A | 11/1995 | Wasser | |
| 6,015,946 A | 1/2000 | Yamaryo | |
| 6,028,256 A | 2/2000 | Straubinger | |
| 6,284,958 B1 * | 9/2001 | Aoki et al. | 84/385 P |
| 6,344,604 B1 | 2/2002 | Schmidt | |

FOREIGN PATENT DOCUMENTS

| | | |
|---|---|---|
| JP | 9-305166 | 11/1997 |

OTHER PUBLICATIONS

Hiroshi, Aoki, "Tone Hole Pad for a Wind Instrument", U.S. patent application Ser. No. 10/270,339, filed Oct. 15, 2002.

* cited by examiner

*Primary Examiner*—Kimberly Lockett
(74) *Attorney, Agent, or Firm*—Wenderoth, Lind & Ponack, L.L.P.

(57) ABSTRACT

A tone hole pad to close a tone hole of a musical wind instrument is mounted in a cup having a bottom portion and a wall portion with a lip which curves inward toward the center thereof to prevent a pad surface from floating. A circular metallic base has a diameter substantially the same as the inside diameter of the wall portion of the cup and is brazed to the bottom surface thereof. The base has a stem portion integral therewith within which a female screw is formed. A ring-shaped concave portion is formed on the peripheral portion of the upper surface of the base, having an inside diameter smaller than the tone hole. A plurality of holes are formed at regular intervals between the stem portion and the ring-shaped concave portion. A peripheral corner portion of the rear surface of the base is beveled to conform to the curved portion of the inside bottom portion of the metal cup. A pad assembly including a felt body, an elastic resin plate and a mount paper is mounted on the metallic base and fixed by a pad washer and a bolt.

11 Claims, 10 Drawing Sheets

TONE HOLE PAD FOR A WIND INSTRUMENT

BACKGROUND OF THE INVENTION

1. Field of the Invention

The present invention relates to a tone hole pad which is mounted within a cup for opening or closing a tone hole of a musical wind instrument.

2. Description of the Prior Art

A conventional tone hole pad for a wind instrument is shown in FIGS. 11 to 15 and comprises a circular metal cup including a bottom portion and a wall portion formed on the periphery of the bottom portion. A screw receiver 33 is brazed to the bottom portion (FIG. 13) and a cushion pad 35 and an adjusting paper 36 are mounted therein. The cushion pad 35 is formed of a thick felt 39 backed by cardboard 40 and wrapped in a pad skin 41 and has a mounting hole 42 formed in the center thereof (FIG. 14). An adjusting paper 36 is first placed on the bottom portion of the cup, and the cushion pad 35 is then mounted thereon and fixed by a pad washer 37 and a bolt 38 (FIG. 15). The adjusting paper 36 may regulate the pad's surface in order to contact with a tone hole rim 34 by increasing or decreasing the surface level. The cup 32 provided with the cushion pad and the adjusting paper is brazed to a lever 31 of a key mechanism provided on the outer surface of the tube body of the instrument.

One of the problems in the prior art tone hole pad is conformability of the cushion pad 35 with the tone hole rim 34 in that air leaks from a gap produced between the pad's surface and the tone hole rim. The first reason for this is that the screw receiver 33 is liable to be obliquely brazed to the bottom portion of the cup 32. The oblique screw receiver makes the pad washer 37 unevenly press the cushion pad 35 against the bottom portion of the cup 32, and, accordingly, deteriorates the conformability of the cushion pad 35. In the process of manufacture, in fact, it is hard for a worker to braze such screw receiver 33 to the bottom portion of the cup 36 evenly, as it requires a skillful technique. The second reason is the uneven bottom portion of the cup 32. When the cushion pad 35 is pressed by the pad washer 37 against the uneven bottom portion of the cup, the cushion pad is then distorted, whereby a gap is produced between the pad's surface and the tone hole's surface, resulting in air leaking, even though the adjusting paper lies on the bottom portion of the cup.

A further problem is that tears in the cushion pad's skin can eventually occur on the portion of the skin that covers the cushion pad. The tears are caused by the pad's inability to maintain an even tension on the skin during repeated contact with the tone hole surface. Therefore, a pad assembly is needed having components that can provide the necessary support for the pad's sealing surface and maintain an even tension on the pad's skin. The deformation of the cushion pad caused by the uneven bottom portion of the cup as described in the previous paragraph is also a cause of tears in the cushion pad's skin. Replacement of the pad assembly requires the installation of a new pad assembly and adjustment thereof to conform the cushion pad's surface to the tone hole surface, which is both time consuming and expensive.

A further problem is that in the prior art tone hole pad, the cushion pad is fixed by a pad washer and bolt in the center. In other words, only central area of the cushion pad is pressed firmly against the bottom portion of the cup. Accordingly, the pressure of the pad washer is concentrated near the center of the pad so that the outer peripheral portion of the cushion pad is forced to float up and protrude out along an edge of the wall portion of the cup, causing distortion of the cushion pad, whereby the pad's conformability deteriorates. Any measures to prevent the outer peripheral portion of the cushion pad's surface from protruding out along the edge of the cup's wall is awaited.

SUMMARY OF THE INVENTION

Accordingly, an object of this invention is to provide a tone hole pad for a musical wind instrument that has solved the problems inherent in the prior art conventional tone hole pad.

To achieve the above object, according to one aspect of this invention, there is provided a tone hole pad for a wind instrument comprising a circular metal cup brazed to a lever of a key mechanism provided on the outer surface of a tube body of a wind instrument. A bottom portion of the cup has an annular wall portion formed on the peripheral portion of the bottom portion. The annular wall portion has a lip which curves inward toward the center thereof to prevent a pad's surface from floating. A circular metallic base is formed of a disk-shaped metal plate having a diameter substantially the same as the inside diameter of the wall portion of the cup and has a stem portion formed integrally therewith exactly perpendicular to the surface thereof, within which a female screw is formed. The circular metallic base is brazed to the bottom portion of the metal cup. The metallic base is also provided with a ring-shaped concave portion (or recess) formed on the peripheral portion of the upper surface thereof with an inside diameter smaller than a tone hole and an appropriate width and depth. A plurality of holes are formed at regular intervals between the central stem portion and the peripheral ring-shaped concave portion. A corner portion of the periphery of the rear surface of the metallic base is beveled to conform to a curved portion of an inner peripheral portion of the bottom portion of the cup.

A pad assembly is comprised of a felt body formed of a disk-shaped piece of felt the upper surface of which is coated with a resin film having the same diameter as that of the metallic base and a mounting hole formed in the center thereof, an elastic resin plate formed of a disk-shaped elastic resin plate having the same diameter as that of the felt body and a mounting hole formed in the center thereof, and a mount paper formed of disk-shaped cardboard having the same diameter as that of the felt body and a mounting hole formed in the center thereof, and a mount paper formed of disk-shaped cardboard having the same diameter as that of the felt body and a mounting hole formed in the center thereof. All of the felt body, the elastic resin plate and the mount paper are mounted on the metallic base in the order of the mount paper, the elastic resin plate and the felt body, from the bottom, and fixed by a pad washer and a bolt in the cup.

In accordance with the tone hole pad of the present invention, the following effects and advantages can be achieved.

First, in the process of manufacture, it is easier to settle the metallic base in a proper position in the bottom portion of the cup owing to the beveled portion formed on the peripheral portion of the rear surface thereof, covering the whole inside rounded portion of the bottom portion of the cup. When the metallic base is brazed to the bottom portion of the cup, a number of the holes perforated between the stem portion and the peripheral concave portion in the metallic base are also of use for a worker, through which he can observe with the eye the brazing work and condition in the other surface of the metallic base. This enhances the work efficiency and contributes to reducing weight.

As a result of this metallic base, a stem portion can be stabilized exactly perpendicular to and in the center of the bottom portion of the cup. Accordingly, the pad assembly can be pressed by a pad washer evenly and uniformly so as to maintain its surface exactly parallel to the tone hole surface to avoid any risk of damage to the pad surface which might cause a gap between the pad's surface and the tone hole. Accordingly, complete conformability of the pad's surface with the tone hole can be ensured.

As comprised of the felt body formed of a thin piece of felt, the upper surface of which is coated with a resin film, the elastic resin plate and the mount paper, the pad assembly itself is elastically deformable and restorable, so that the pad's surface does not suffer from excessive pressure from the tone hole by a player's strong touch or uneven pressure by distortion of the tone hole. In addition, the mount paper deflects into the space portion formed in the ring-shaped concave portion on the peripheral portion of the upper surface of the metallic base, so that the shock caused when the tone hole is closed is alleviated.

DESCRIPTION OF THE PREFERRED EMBODIMENTS

The embodiments of the present invention will be described with reference to the accompanying drawings. However, it is needless to say that the present invention is not restricted to the embodiments described below.

Figure 1:
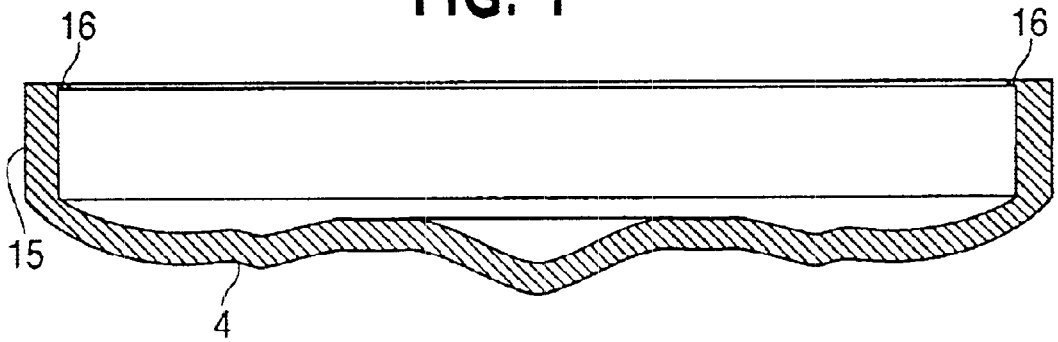
FIG. 1 is a sectional view of a metal cup of the present invention.
Figure 2:
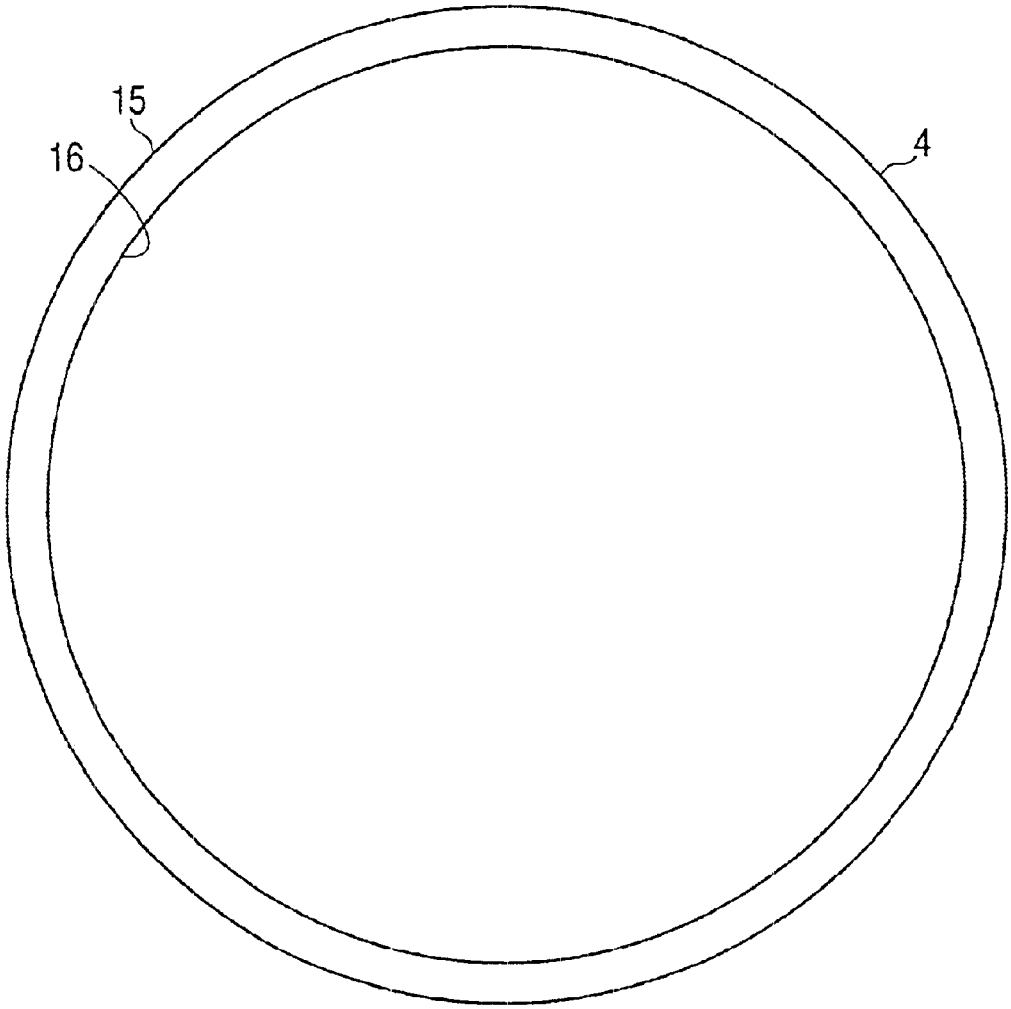
FIG. 2 is a plan view of the metal cup.

FIGS. 1 and 2 show a metal cup 4 having a bottom portion and a wall portion 15 formed on the peripheral portion of the bottom portion. The wall portion has a lip 16 which curves inward toward the center thereof for preventing a pad's surface from floating.

Figure 3:
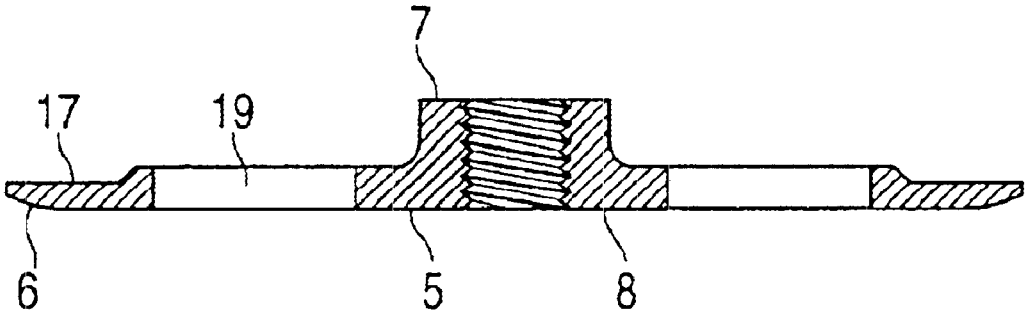
FIG. 3 is sectional view of a circular metallic base of the present invention.
Figure 4:
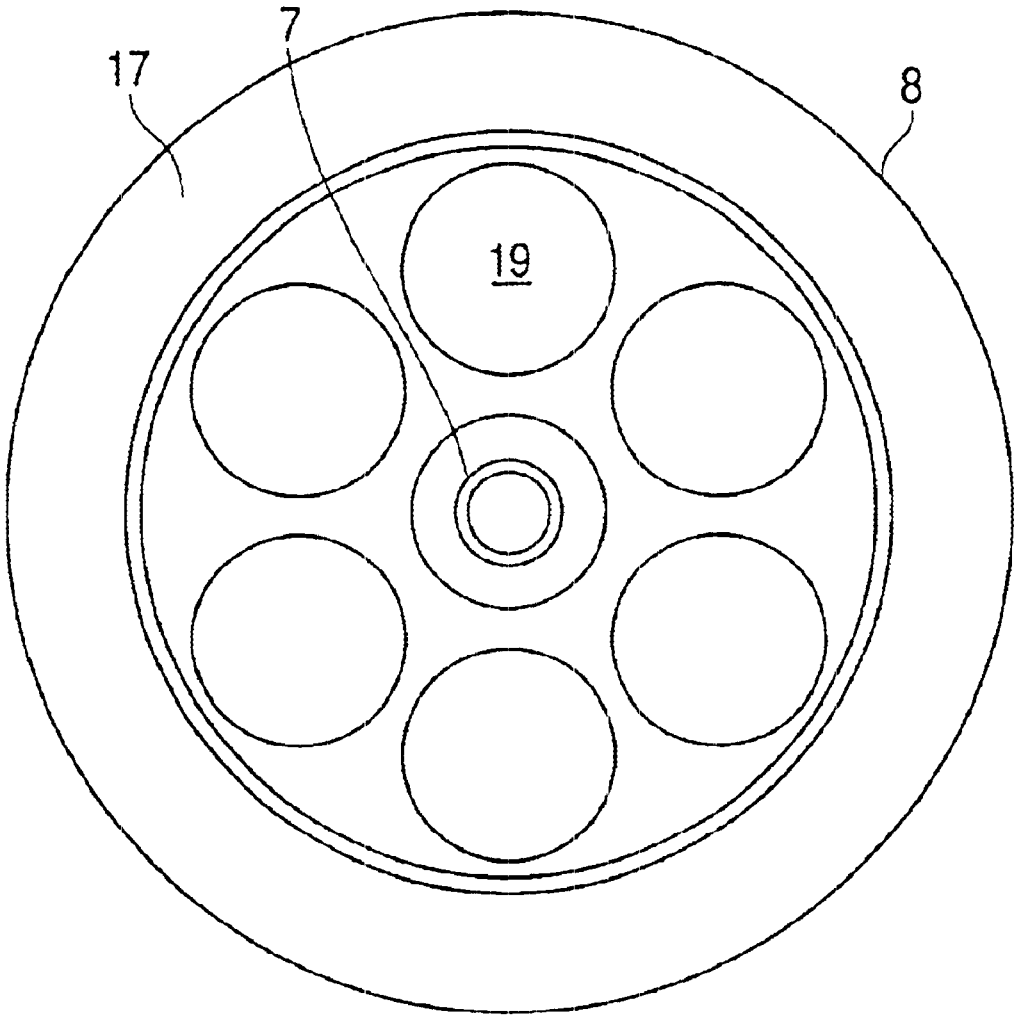
FIG. 4 is a plan view of the circular metallic base.
Figure 5:
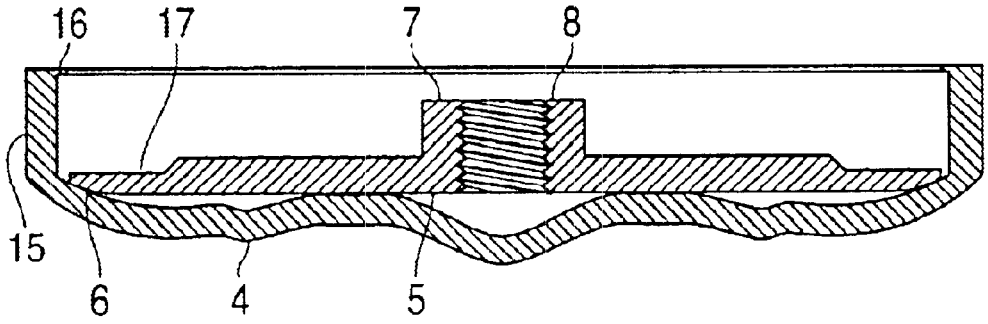
FIG. 5 is a sectional view of the circular metallic base brazed to the metal cup.
Figure 6:
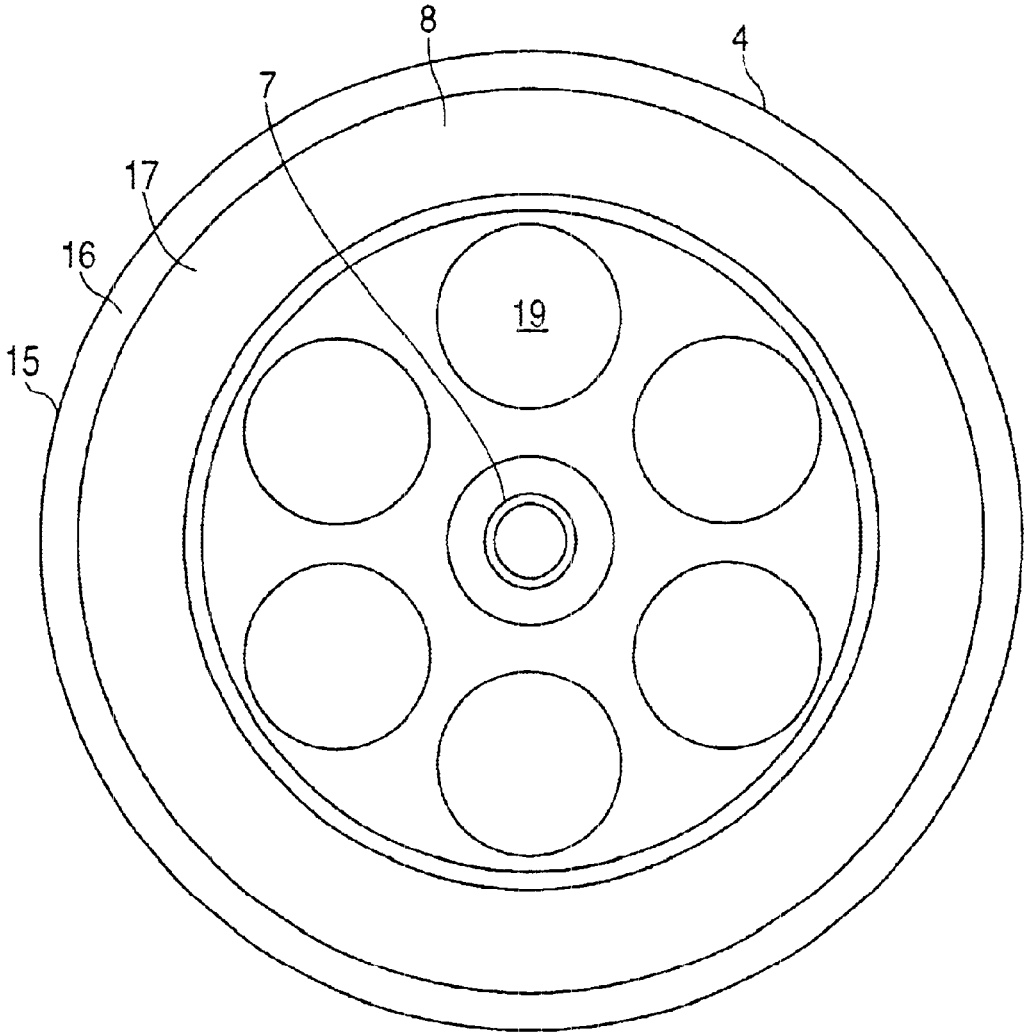
FIG. 6 is a plan view of the metal base brazed to the metal cup.

FIGS. 3 and 4 show a circular metallic base 8 and a stem portion 7 integrally formed therewith, within which a female screw is formed. The circular metallic base has a diameter substantially the same as the inside diameter of the wall portion of the metal cup and is provided with a ring-shaped concave portion or recess 17 having an inside diameter smaller than that of a tone hole 1 and an appropriate width and depth. The recess 17 is formed in the peripheral portion of the upper surface of the base 8. A plurality of holes 19 are formed at regular intervals between the stem portion and the ring-shaped concave portion, as shown in FIGS. 3 and 4. These holes 19 are helpful during brazing work. A worker can see with his eye his brazing work and the condition of the other surface of the metallic base when it is brazed to the bottom portion of the cup through the holes 19, see FIGS. 5 and 6. The holes also contribute to reducing the weight. A peripheral portion of the rear surface of the metallic base 8 is beveled at 6 to coincide with the curved portion of the inner peripheral portion of the metal cup 4, so that the metal base can be easily placed in a proper position in the bottom portion of the cup and brazed thereto, see FIG. 5.

Figure 7:
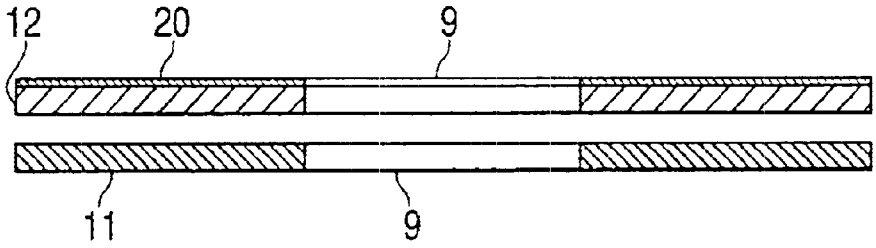
FIG. 7 is a sectional view of a felt body and an elastic resin plate.
Figure 8:
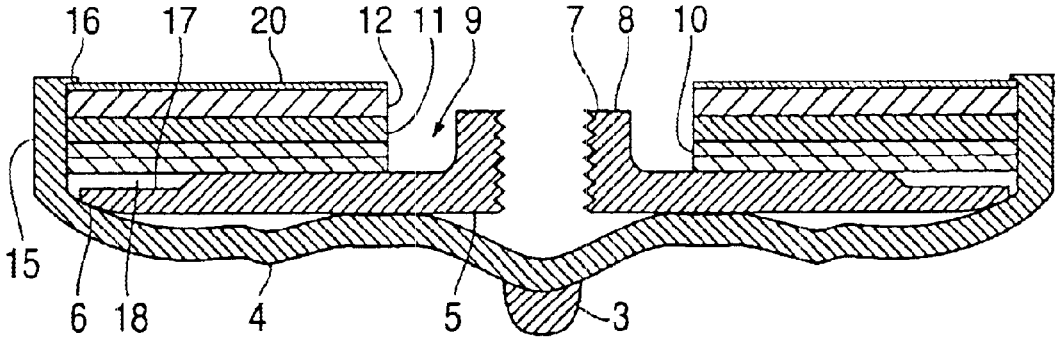
FIG. 8 is a sectional view showing a state in which the felt body, the elastic resin plate and a circular mount paper are mounted on the metallic base in the metal cup.

FIG. 7 shows a felt body 12 which is formed of a disk-shaped piece of felt, the upper surface of which is coated with a resin film 20, made e.g. from polyvinyl chloride. The felt body 12 has a diameter substantially the same as the inside diameter of the wall portion of the metal cup and a mounting hole 9 formed in the center thereof. An elastic resin plate 11 is formed from a disk-shaped elastic resin plate such as silicone rubber having the same diameter as that of the felt body and a mounting hole 9 formed in the center thereof. A mount paper 10 is formed of cardboard having the same diameter as that of the felt body and a mounting hole formed in the center thereof The pad elements are mounted on the metallic base in the order of the mount paper 10, the resin plate 11, and the felt body 12, from the bottom, as shown in FIG. 8. The mount paper 10 serves as an adjusting member in order to regulate the desired level of the pad's surface for contact with tone hole rim 1.

Figure 9:
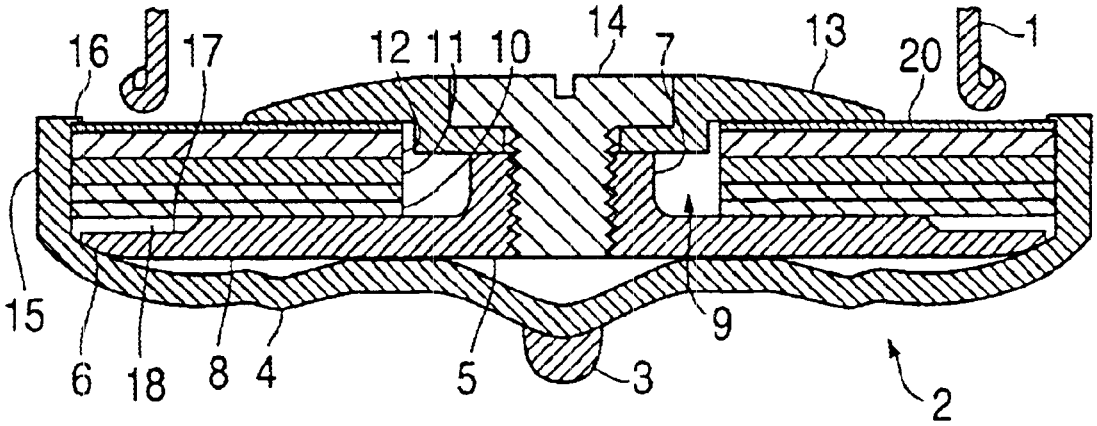
FIG. 9 is a sectional view of a finished tone hole pad of the present invention and a tone hole rim.

As shown in FIG. 9, all of the elements are finally fixed in the cup by a pad washer 13 and a bolt 14. The cup is brazed to a lever 3 of a key mechanism provided on the outer surface of a tube body of the instrument.

Figure 10:
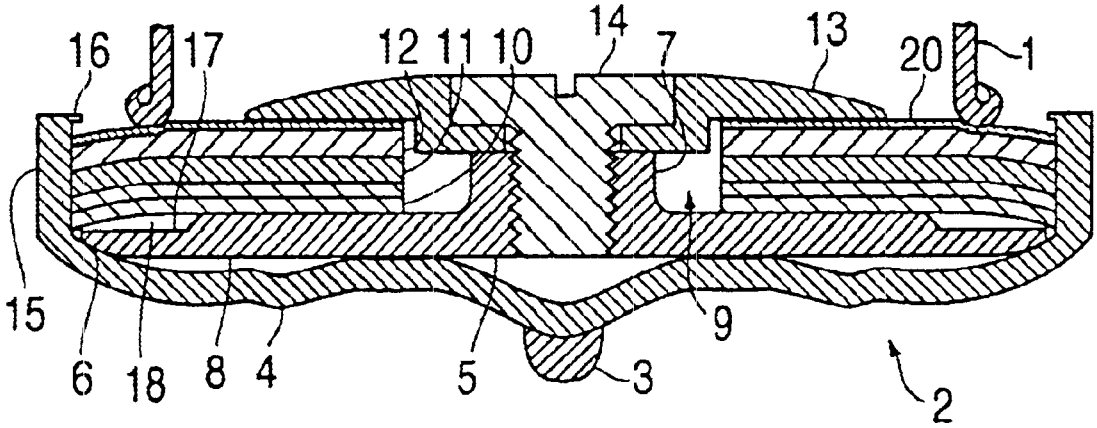
FIG. 10 is a sectional view showing a state in which the tone hole is closed by the tone hole pad of the present invention.
Figure 11:
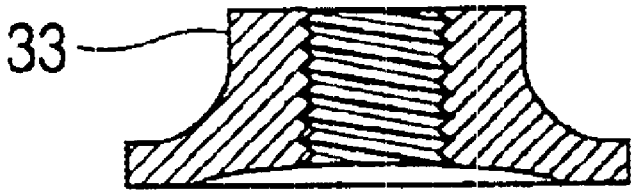
FIG. 11 (PRIOR ART)
FIG. 11 is a sectional view of a prior art screw receiver.
Figure 12:
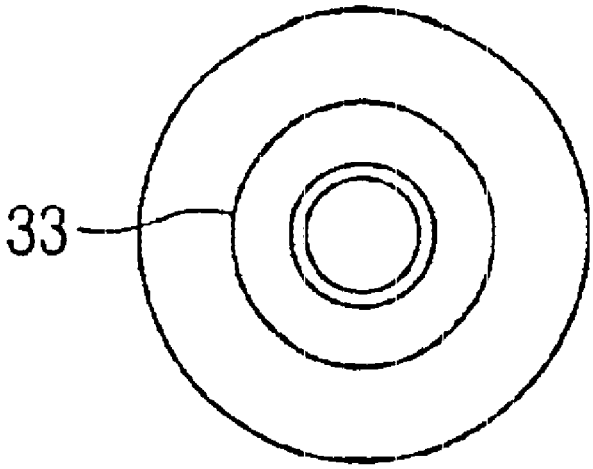
FIG. 12 (PRIOR ART)
FIG. 12 is a plan view of the prior art screw receiver.
Figure 13:
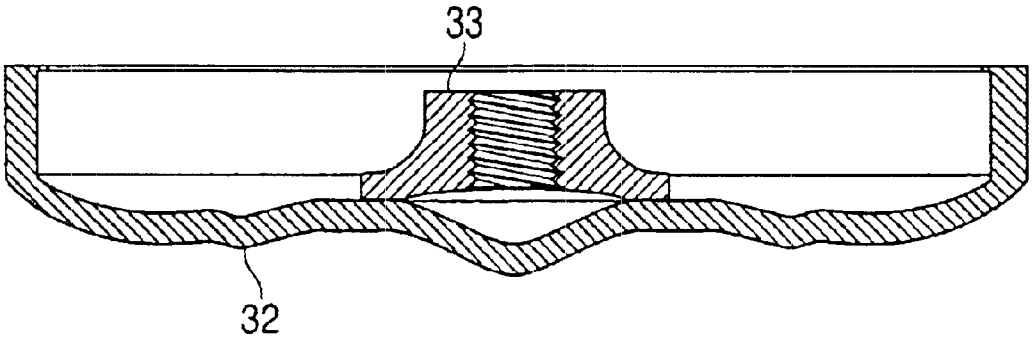
FIG. 13 (PRIOR ART)
FIG. 13 is a sectional view of the prior art screw receiver brazed to a cup.
Figure 14:
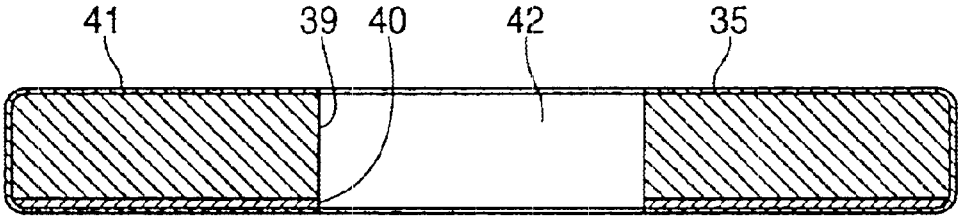
FIG. 14 (PRIOR ART)
FIG. 14 is a sectional view of a prior art cushion pad.
Figure 15:
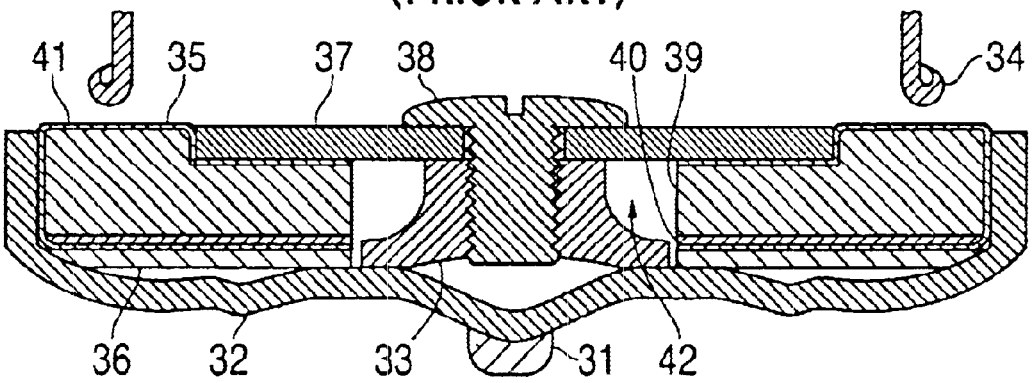
FIG. 15 (PRIOR ART)
FIG. 15 is a sectional view of the prior art tone hole pad.

FIG. 10 shows a state in which the tone hole 1 is closed. The mount paper 10 deflects into a space portion 18 formed in the ring-shaped concave portion 17 of the peripheral portion of the upper surface of the metallic base 8, whereby the shock caused when the tone hole is closed is moderated and a comfortable key touch is given to an instrument player.

What is claimed:

1. A tone hole pad assembly for a tone hole pad for opening and closing a tone hole of a wind instrument, comprising:

a metal cup having a bottom portion and a wall portion with a lip;

a circular metallic base inside said metal cup, said base having a diameter substantially the same as the inside diameter of said wall portion of said metal cup, a stem portion integral with said metal base and having an internal female screw, a ring-shaped concave portion in a peripheral portion of said base, said concave portion having an inside diameter smaller than the tone hole, a plurality of holes formed at regular intervals between said stem portion and said ring shaped concave portion, and a beveled portion formed on a peripheral portion of a rear surface of said metallic base.

2. The tone hole pad assembly of claim 1, wherein said lip extends inward toward a center of said metal cup.

3. The tone hole pad of claim 1, wherein said beveled portion conforms with a bottom portion of said metal cup.

4. A tone hole pad for opening and closing a tone hole of a wind instrument, comprising:

a cup having a bottom portion and a wall portion with a lip;

a circular base inside said cup, said base having a diameter substantially the same as the inside diameter of said wall portion of said cup and an annular recess in a peripheral portion of said base, said recess having an inside diameter smaller than the tone hole; and a pad assembly mounted on said circular base, said pad assembly extending over said recess and being retained in said cup by said lip of said cups;

wherein said lip extends inward toward a center of said cup.

5. The tone hole pad of claim 4, wherein said cup is metal and said circular base is metallic.

6. The tone hole pad of claim 5, wherein said circular base has a plurality of holes therein between said recess and a center thereof.

7. The tone hole pad of claim 4, wherein said circular base has an integral central stem, wherein a washer is connected to said stem to hold said pad assembly.

8. The tone hole pad of claim 7, wherein said stem has an internal female screw receiving a bolt holding said washer.

9. A tone hole pad for opening and closing a tone hole of a wind instrument, comprising:

a cup having a bottom portion and a wall portion with a lip:

a circular base inside said cup, said base having a diameter substantially the same as the inside diameter of said wall portion of said cup and an annular recess in a peripheral portion of said base, said recess having an inside diameter smaller than the tone hole: and a pad assembly mounted on said circular base, said pad assembly extending over said recess and being retained in said cup by said lip of said cup wherein said circular base has an annular peripheral beveled portion on its rear surface for conforming said circular base to a curved bottom portion of said cup.

10. The tone hole pad of claim 4, wherein said pad assembly comprises a felt body coated with a resin film, a resin plate and a mount paper.

11. The tone hole pad of claim 9, wherein said beveled portion is brazed to said curved bottom portion of said cup.

* * * * *